US009920579B2

(12) United States Patent
Newman

(10) Patent No.: US 9,920,579 B2
(45) **Date of Patent: *Mar. 20, 2018**

(54) BOREHOLE DRILL BIT CUTTER INDEXING

(71) Applicant: US Synthetic Corporation, Orem, UT (US)

(72) Inventor: Cole Newman, Gunnison, UT (US)

(73) Assignee: US Synthetic Corporation, Orem, UT (US)

( * ) Notice: Subject to any disclaimer, the term of this patent is extended or adjusted under 35 U.S.C. 154(b) by 518 days.

This patent is subject to a terminal disclaimer.

(21) Appl. No.: 14/599,154

(22) Filed: Jan. 16, 2015

(65) Prior Publication Data

US 2015/0129310 A1 May 14, 2015

Related U.S. Application Data

(63) Continuation of application No. 13/288,847, filed on Nov. 3, 2011, now Pat. No. 8,950,516.

(51) Int. Cl.

| | |
|---|---|
| ***E21B 10/62*** | (2006.01) |
| ***E21B 10/36*** | (2006.01) |
| *E21B 10/573* | (2006.01) |
| *E21B 3/00* | (2006.01) |
| *E21B 10/42* | (2006.01) |
| *E21B 10/55* | (2006.01) |

(52) U.S. Cl.

CPC ..... *E21B 10/62* (2013.01); *E21B 10/36* (2013.01); *E21B 3/00* (2013.01); *E21B 10/42* (2013.01); *E21B 10/55* (2013.01); *E21B 10/573* (2013.01)

(58) Field of Classification Search

CPC ..... E21B 10/36; E21B 10/62

See application file for complete search history.

(56) References Cited

U.S. PATENT DOCUMENTS

| | | | |
|---|---|---|---|
| 1,686,403 | A | 10/1928 | Boynton |
| 1,723,381 | A | 8/1929 | Seifert |
| 1,790,613 | A | 1/1931 | Gildersleeve et al. |
| 2,289,707 | A | 7/1942 | Hellman |
| 2,506,341 | A | 5/1950 | Bullock |
| 2,631,360 | A | 3/1953 | Sanford et al. |
| 2,710,180 | A | 6/1955 | Graham |

(Continued)

FOREIGN PATENT DOCUMENTS

| | | |
|---|---|---|
| WO | 8606990 | 12/1986 |
| WO | 2005021191 | 3/2005 |
| WO | 2007044791 | 4/2007 |

OTHER PUBLICATIONS

PCT/US2012/062432, International Search Report, Apr. 22, 2013.

(Continued)

*Primary Examiner* — Nicole Coy
*Assistant Examiner* — Kristyn A Hall
(74) *Attorney, Agent, or Firm* — Holland & Hart

(57) ABSTRACT

For drill bit cutter indexing, a housing is disposed in a drill bit. An indexing cog is in physical communication with a cutter and interlocks with the housing in a first index position of a plurality of index positions in response to a first compressive load applied to the cutter. A motivator disengages the indexing cog from the housing and positions the indexing cog to interlock with the housing at an initial second index position in response to a removal of the compressive load from the cutter.

18 Claims, 14 Drawing Sheets

(56) References Cited

U.S. PATENT DOCUMENTS

| | | | |
|---|---|---|---|
| 2,879,049 | A | 3/1959 | Poundstone |
| 2,917,819 | A | 12/1959 | Britton et al. |
| 3,136,615 | A | 6/1964 | Bovenkerk et al. |
| 3,141,746 | A | 7/1964 | De Lai |
| 3,271,080 | A | 9/1966 | Gowanlock |
| 3,528,516 | A | 9/1970 | Brown |
| 3,565,192 | A | 2/1971 | McLarty |
| 3,720,273 | A | 3/1973 | McKenry et al. |
| 3,749,190 | A | 7/1973 | Shipman |
| 3,763,492 | A | 10/1973 | Easton |
| 3,847,236 | A | 11/1974 | Coalson |
| 4,014,395 | A | 3/1977 | Pearson |
| 4,047,583 | A | 9/1977 | Dyer |
| 4,057,884 | A | 11/1977 | Suzuki |
| 4,073,354 | A | 2/1978 | Rowley et al. |
| 4,199,035 | A | 4/1980 | Thompson |
| 4,200,159 | A | 4/1980 | Peschel et al. |
| 4,201,421 | A | 5/1980 | Den Besten et al. |
| 4,222,446 | A | 9/1980 | Vasek |
| 4,337,980 | A | 7/1982 | Krekeler |
| 4,350,215 | A | 9/1982 | Radtke |
| 4,386,669 | A | 6/1983 | Evans |
| 4,396,077 | A | 8/1983 | Radtke |
| 4,453,605 | A | 6/1984 | Short, Jr. |
| 4,466,498 | A | 8/1984 | Bardwell |
| 4,511,006 | A | 4/1985 | Grainger |
| 4,538,690 | A | 9/1985 | Short, Jr. |
| 4,553,615 | A | 11/1985 | Grainger |
| 4,654,947 | A | 4/1987 | Davis |
| 4,690,228 | A | 9/1987 | Voelz et al. |
| 4,694,918 | A | 9/1987 | Hall |
| 4,720,216 | A | 1/1988 | Smith |
| 4,751,972 | A | 6/1988 | Jones et al. |
| 4,782,903 | A | 11/1988 | Strange |
| 4,802,539 | A | 2/1989 | Hall et al. |
| 4,877,096 | A | 10/1989 | Tibbitts |
| 5,007,493 | A | 4/1991 | Coolidge et al. |
| 5,007,685 | A | 4/1991 | Beach et al. |
| 5,056,382 | A | 10/1991 | Clench |
| 5,181,576 | A | 1/1993 | Askew et al. |
| 5,279,375 | A | 1/1994 | Tibbitts et al. |
| 5,293,945 | A | 3/1994 | Rosenbauch et al. |
| 5,318,138 | A | 6/1994 | Dewey et al. |
| 5,332,051 | A | 7/1994 | Knowlton |
| 5,351,772 | A | 10/1994 | Smith |
| 5,469,927 | A | 11/1995 | Griffin |
| 5,558,170 | A | 9/1996 | Thigpen et al. |
| 5,678,645 | A | 10/1997 | Tibbitts et al. |
| 5,810,103 | A | 9/1998 | Torbet |
| 5,906,245 | A | 5/1999 | Tibbitts et al. |
| 5,947,214 | A | 9/1999 | Tibbitts et al. |
| 5,975,811 | A | 11/1999 | Briese |
| 6,070,677 | A | 6/2000 | Johnston, Jr. |
| 6,073,524 | A | 6/2000 | Weiss et al. |
| 6,283,234 | B1 | 9/2001 | Torbet |
| 6,302,224 | B1 | 10/2001 | Sherwood, Jr. |
| 6,408,959 | B2 | 6/2002 | Bertagnolli et al. |
| 6,655,479 | B2 | 12/2003 | Kleine et al. |
| 6,733,087 | B2 | 5/2004 | Hall et al. |
| 6,733,365 | B1 | 5/2004 | Shaw et al. |
| 7,048,080 | B2 | 5/2006 | Griffo et al. |
| 7,070,011 | B2 | 7/2006 | Sherwood, Jr. et al. |
| 7,192,226 | B2 | 3/2007 | Unsworth |
| 7,533,709 | B2 | 5/2009 | Meyer |
| 7,533,720 | B2 | 5/2009 | Robichaux et al. |
| 7,533,739 | B2 | 5/2009 | Cooley et al. |
| 7,604,073 | B2 | 10/2009 | Cooley et al. |
| 7,681,646 | B2 | 3/2010 | Robichaux et al. |
| 7,681,665 | B2 | 3/2010 | Eppink |
| 7,845,436 | B2 | 12/2010 | Cooley et al. |
| 7,882,905 | B2 | 2/2011 | Radford et al. |
| 7,913,760 | B2 | 3/2011 | Robichaux et al. |
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,146,663 | B2 | 4/2012 | Robichaux et al. |
| 8,210,285 | B2 | 7/2012 | Cooley et al. |
| 8,297,348 | B2 | 10/2012 | Robichaux et al. |
| 8,528,631 | B2 | 9/2013 | Robichaux et al. |
| 8,561,728 | B2 | 10/2013 | Cooley et al. |
| 2002/0053472 | A1 | 5/2002 | Kleine et al. |
| 2005/0183892 | A1 | 8/2005 | Oldham et al. |
| 2007/0278017 | A1 | 12/2007 | Shen et al. |
| 2008/0017419 | A1 | 1/2008 | Cooley et al. |
| 2008/0085407 | A1 | 4/2008 | Cooley et al. |
| 2008/0196891 | A1* | 8/2008 | Mailand ..... E21B 23/006 166/255.2 |
| 2009/0020339 | A1 | 1/2009 | Sherwood |
| 2010/0200298 | A1 | 8/2010 | Mackenzie |
| 2010/0031417 | A1 | 12/2010 | Zhang et al. |
| 2010/0314176 | A1 | 12/2010 | Zhang et al. |
| 2011/0088955 | A1 | 4/2011 | Cooley et al. |
| 2014/0020956 | A1 | 1/2014 | Cooley et al. |

OTHER PUBLICATIONS

PCT/US2006/039692, International Search Report, dated Mar. 6, 2007.

EP 09 01 2820, European Search Report , dated Nov. 18, 2009.

WO8606990, English Abstract, Dec. 4, 1986.

* cited by examiner

BOREHOLE DRILL BIT CUTTER INDEXING

CROSS-REFERENCE TO RELATED APPLICATIONS

This application is a continuation of, and claims benefit to, U.S. patent application Ser. No. 13/288,847, filed Nov. 3, 2011, the disclosure of which is incorporated by reference herein in its entirety.

FIELD

The subject matter disclosed herein relates to borehole drill bit cutters and more particularly relates to borehole drill bit cutter indexing.

BACKGROUND

Description of the Related Art

The drill bits used to drill boreholes, particularly fixed cutter bits, employ cutters to fragment rock.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

References throughout this specification to features, advantages, or similar language do not imply that all of the features and advantages may be realized in any single embodiment. Rather, language referring to the features and advantages is understood to mean that a specific feature, advantage, or characteristic is included in at least one embodiment. Thus, discussion of the features and advantages, and similar language, throughout this specification may, but do not necessarily, refer to the same embodiment.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The schematic flowchart diagrams and/or schematic block diagrams in the Figures illustrate the architecture, functionality, and operation of possible implementations of apparatuses, systems, and methods according to various embodiments of the present invention. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only one embodiment of the functional flow.

Figure 1:
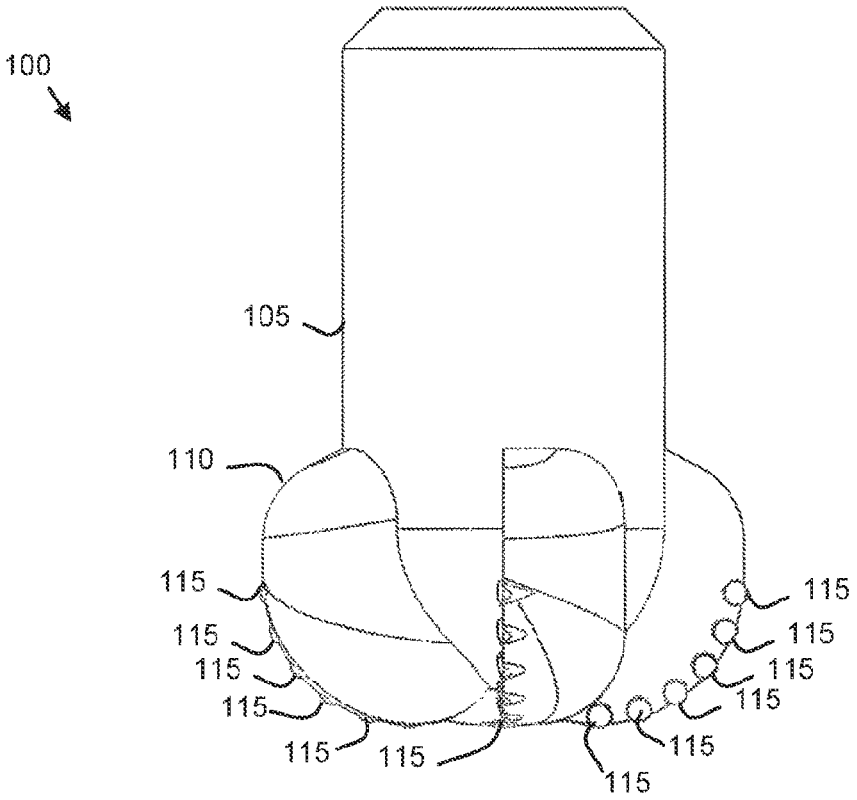
FIG. 1 is a side-view drawing illustrating one embodiment of a borehole drill bit.

FIG. 1 is a side-view drawing illustrating one embodiment of a borehole drill bit 100. In the depicted embodiment, the drill bit 100 is a fixed cutter drill bit 100, such as a polycrystalline diamond compact (PDC) or a grit hot pressed inserts (GHI) drill bit. Alternatively, the drill bit 100 may be a roller cone drill bit.

The drill bit 100 includes a shaft 105 and a head 110. A plurality of cutters 115 is disposed about the head 110. For clarity, only representative cutters 115 are labeled. In one embodiment, the cutters 115 grind against the rock interface during the drilling operation to fragment the rock.

Figure 2:
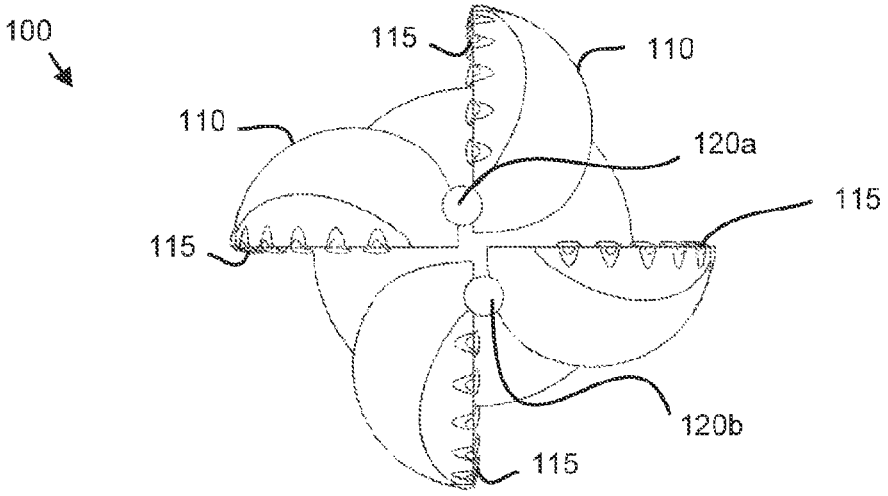
FIG. 2 is a bottom-view drawing illustrating one embodiment of a borehole drill bit.

FIG. 2 is a bottom-view drawing illustrating one embodiment of the drill bit 100. The drill bit 100 is a drill bit 100 of FIG. 1. The description of the drill bit 100 refers to elements of FIG. 1, like numbers referring to like elements. The drill bit includes a plurality of cutters 115. For clarity, only representative cutters 115 are labeled. The drill bit 100 includes or more openings 120. At least one opening 120 allows drilling fluid or drilling mud to be pumped into the drilling interface while least one other opening 120 removes the drilling fluid from the drilling interface.

Figure 3:
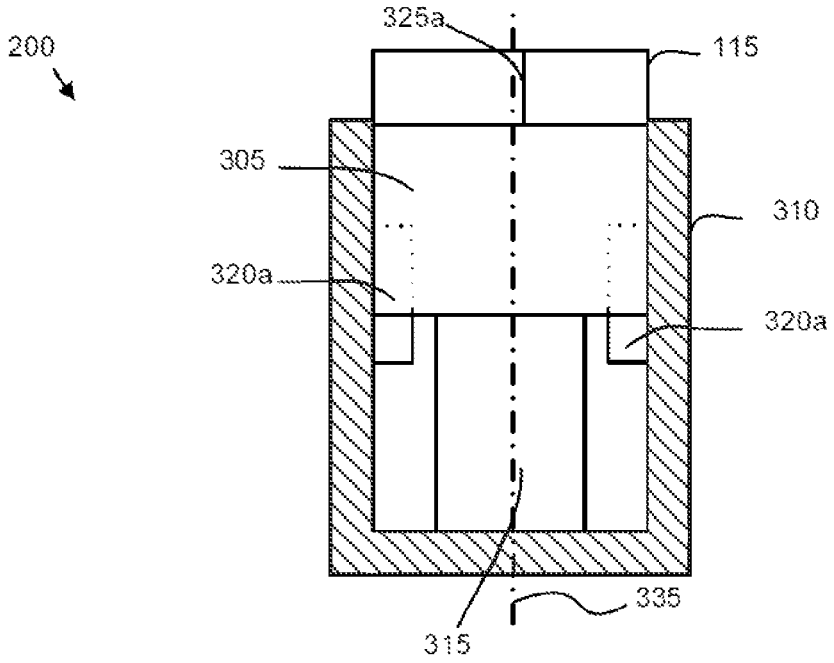
FIG. 3 is a partial cross-sectional view of one embodiment of a compressed indexing cutter apparatus.

FIG. 3 is a partial cross-sectional view of one embodiment of a compressed indexing cutter apparatus 200. The apparatus 200 may secure the cutter 115 within the drill bit 100. The description of the apparatus 200 refers to elements of FIGS. 1-2, like numbers referring to like elements. The apparatus 200 includes the cutter 115, a housing 310, an indexing cog 305, and a motivator 315. The apparatus 200 may also include a least one protrusion 320. In addition, a central axis 335 of the apparatus 200 is shown.

The housing 310 is disposed in the drill bit 100. The housing 310 may be integrated into the drill bit 100 in a cutter pocket (not shown). Alternatively, the housing 310 may be secured within the drill bit 100 by being press fit, using a mechanical locking mechanism, using a weld, or the like.

The indexing cog 305 is in physical communication with the cutter 115. The indexing cog 305 may be bonded, welded, mechanically fastened, or the like to the cutter 115. The indexing cog 305 interlocks with the housing 310 in a plurality of index positions that will be described hereafter. A different portion of the cutter 115 is primarily in contact with the rock in each index position.

If a portion of the cutter 115 is worn away during the drilling operation, the efficacy of the cutter 115 is diminished. In the past, when the efficacy of the cutters 115 on a drill bit 100 was sufficiently diminished, the drill bit 100 was raised to the surface and replaced. This replacement of the drill bit 100 is extremely costly to a drilling operation. The embodiments described herein index the cutter 115 to the new index position, exposing a new portion of the cutter 115 to the rock. As a result, the efficacy of the cutter 115 is maintained for a significantly longer time, resulting in substantial savings for the drilling operation.

In the depicted embodiment, a first index position 325*a* is indicated with a line. The protrusions 320 may secure the indexing cog 305 in the first index position 325*a*. In one embodiment, the protrusions 320 interlock with the indexing cog 305 to secure the indexing cog 305 to the housing 310 in each index position 325. In one embodiment, the index cog 305 comprises teeth that interlock with one or more edges of the protrusion 320. Alternatively, the protrusion 320 may fit within a slot of the indexing cog 305 in a tongue and groove manner to interlock the index cog 305 with the housing 310. In a certain embodiment, the protrusion 320 is disposed on the index cog 305 and interlocks with a groove of the housing 310. One of skill in the art will recognize that embodiments may also be practiced with slots, indentations, and fasteners interlocking with the indexing cog 305 to secure the indexing cog 305 to the housing 310.

The motivator 315 may attempt to disengage the indexing cog 305 from the housing 310. However, while compressive load is applied to the cutter 115 and overcomes the force of the motivator 315, the indexing cog 305 is securely interlocked with the housing 310, preventing the indexing cog 305 from indexing from the first indexing position 325*a* to another indexing position 325. The motivator 315 may include one or more springs, a pneumatic actuator, a hydraulic actuator, an electrical actuator, a piezoelectric actuator, a thermal actuator, or the like.

Figure 4:
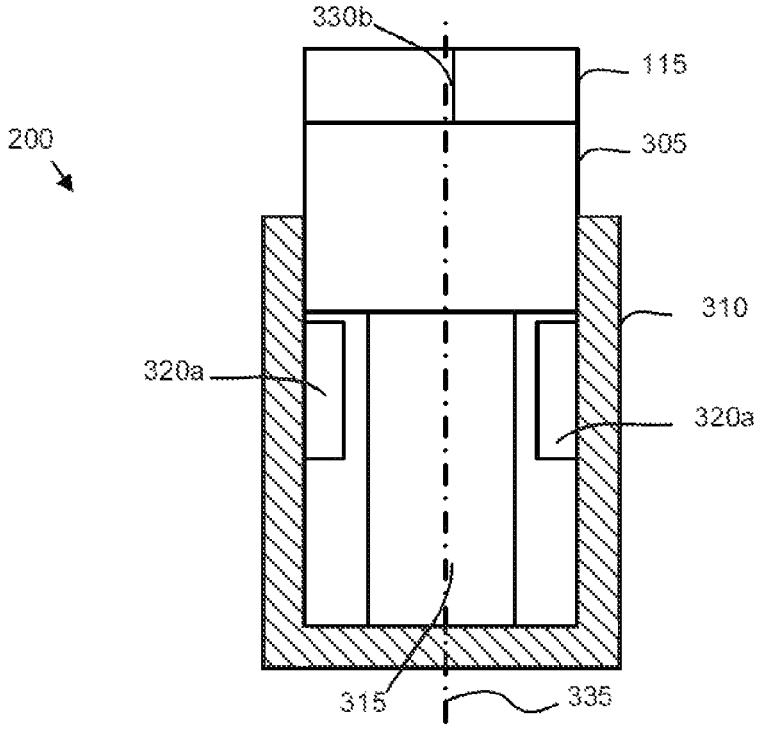
FIG. 4 is a partial cross-sectional view of one embodiment of an uncompressed indexing cutter apparatus.

FIG. 4 is a partial cross-sectional view of one embodiment of an uncompressed indexing cutter apparatus 200. The apparatus 200 of FIG. 3 is shown after the compressive load on the cutter 115 is removed. In one embodiment, the compressive load is removed when the drill bit 100 is lifted away from the rock interface in the borehole. The description of the apparatus 200 refers to elements of FIGS. 1-3, like numbers referring to like elements.

With the compressive load on the cutter 115 removed, the motivator 315 disengages the indexing cog 305 from the housing 310. In addition, the motivator 315 positions the indexing cog 305 to interlock with the housing 310 at an initial second index position 330*b*. In one embodiment, the initial second index position 330*b* is offset from the first index position 325*a* at an offset angle about the central axis 335. The offset angle may be in the range of 0.5° to 5°. In one embodiment, when the compressive force is reapplied to the cutter 115 in the initial second index position 330*b*, the indexing cog 305 is positioned to interlock with the housing 310 in a second index position in response to the compressive force as will be described hereafter. In a certain embodiment, the initial second index position 330*b* is the second index position.

Figure 5:
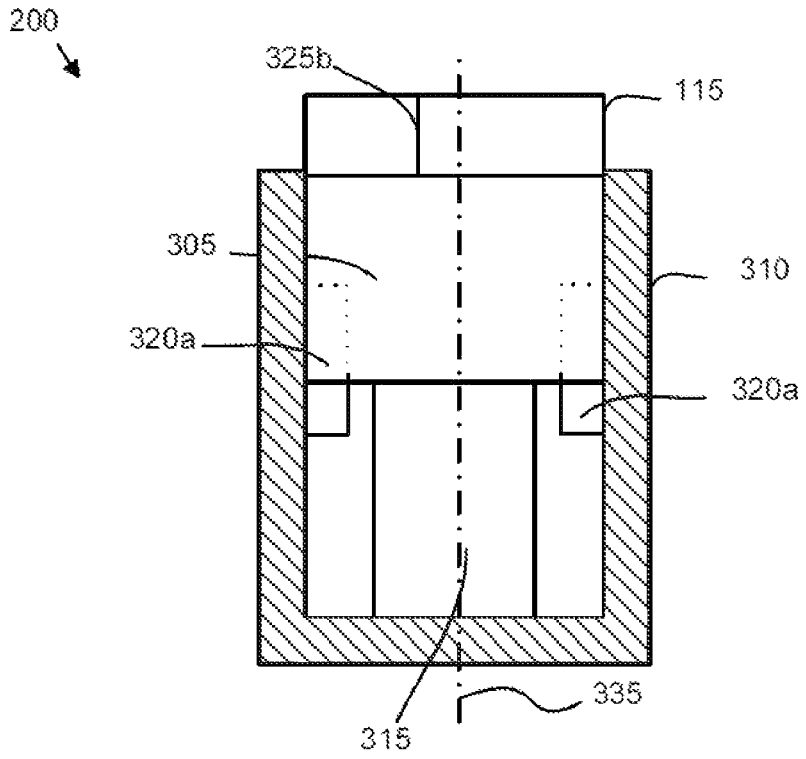
FIG. 5 is a partial cross-sectional view of one embodiment of a recompressed indexing cutter apparatus.

FIG. 5 is a partial cross-sectional view of one embodiment of a recompressed indexing cutter apparatus 200. The apparatus 200 is the apparatus 200 of FIG. 4 after the compressive load is reapplied to the cutter 115. In one embodiment, the compressive force is reapplied as the drill bit 100 is lowered against the rock interface in the borehole. The description of the apparatus 200 refers to elements of FIGS. 1-4, like numbers referring to like elements.

The compressive load of the drill bit 100 against the rock interface is reapplied to the cutter 115 as a second compressive load. The second compressive load pushes against and overcomes the force of the motivator 315, motivating the indexing cog 305 to interlock with the housing 310 in the second index position 325*b*. As a result, a new portion of the cutter 115 contacts the rock interface. By indexing the cutter 115 and presented a new portion of the cutter 115 to the rock interface, the drill bit 100 may continue drilling operations with high efficacy, without removing the drill bit 100 from the borehole.

Figure 6:
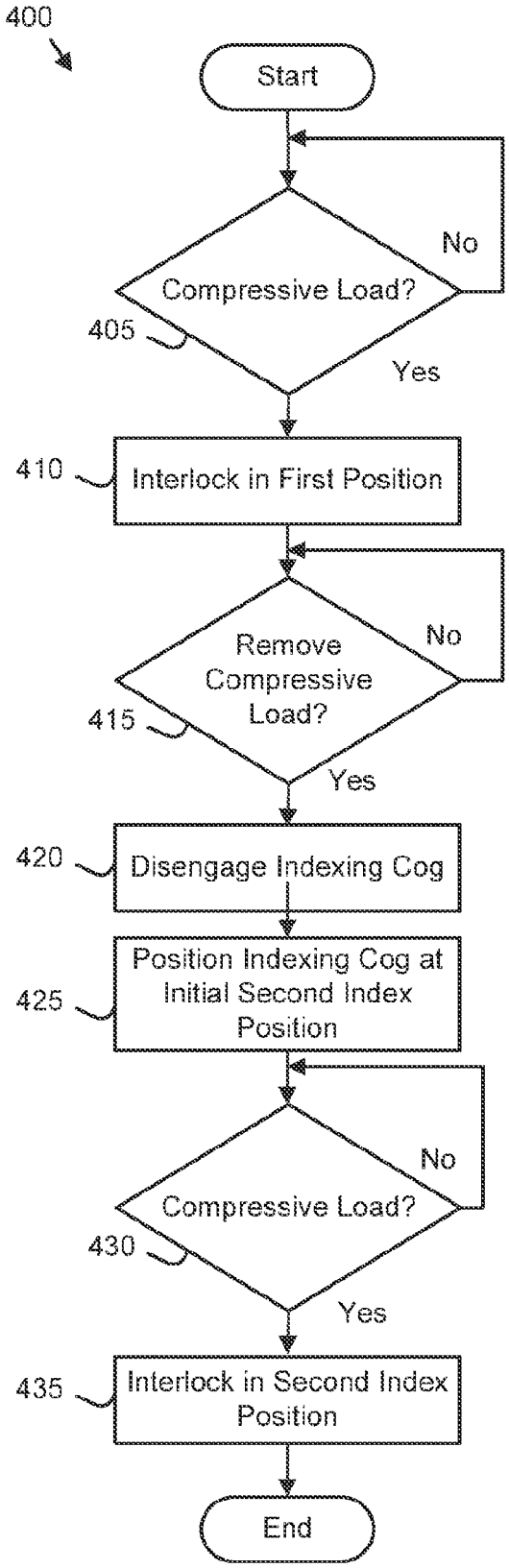
FIG. 6 is a schematic flow chart diagram illustrating one embodiment of a cutter indexing method.

FIG. 6 is a schematic flow chart diagram illustrating one embodiment of a cutter indexing method 400. The method 400 may perform the functions of the apparatus 200 of FIGS. 3-5. The description of the method 400 refers to elements of FIGS. 1-5, like numbers referring to like elements.

The method 400 starts, and in one embodiment a compressive load is not applied to the cutter 115. In one embodiment, the indexing cog 305 is positioned in an initial first index position. The indexing cog 305 may continue in the initial first index position until the compressive load is applied 405 to the cutter 115.

When the compressive load is applied 405 to the cutter, the compressive load pushes against the force of the motivator 315 and interlocks 410 the indexing cog 305 with the housing 310 in the first index position 325*a*. The indexing cog 305 is held 415 in the first index position 325*a* by the housing 310 until the compressive load is removed 415.

When the compressive load is removed 415, the motivator 315 disengages 420 the indexing cog 305 from the housing 310. In addition, the motivator 315 may position 425 the indexing cog 305 at the initial second index position 330*b*.

In one embodiment, the indexing caught 305 remains 430 in the initial second index position 330*b* until the compressive load is applied to the cutter 115. When the compressive load is applied 430 to the cutter 115 as a second compressive load, the indexing cog 305 interlocks with the housing 310 in the second index position 325*b* in response to the compressive load applied to the cutter 115 and the method 400 ends. In one embodiment, the interaction of the indexing cog 305 and the protrusion 320 guide the indexing cog 305 to the second index position 330*b* in response to the compressive load.

The method 400 indexes the cutter 115 from the first index position 325*a* to the second index position 325*b* by removing 415 the compressive load on the cutter 115 and then reapplying 430 the compressive load to the cutter 115. As a result, the drill bit 100 may remain in the borehole much longer than without indexing of the cutter 115. A drilling operation need only briefly disengage the drill bit 100 from the rock interface to index the cutter 115. Thus each cutter 115 maybe repeatedly indexed while in the borehole to display a fresh portion of the cutter 115 to the rock interface.

Figure 7:
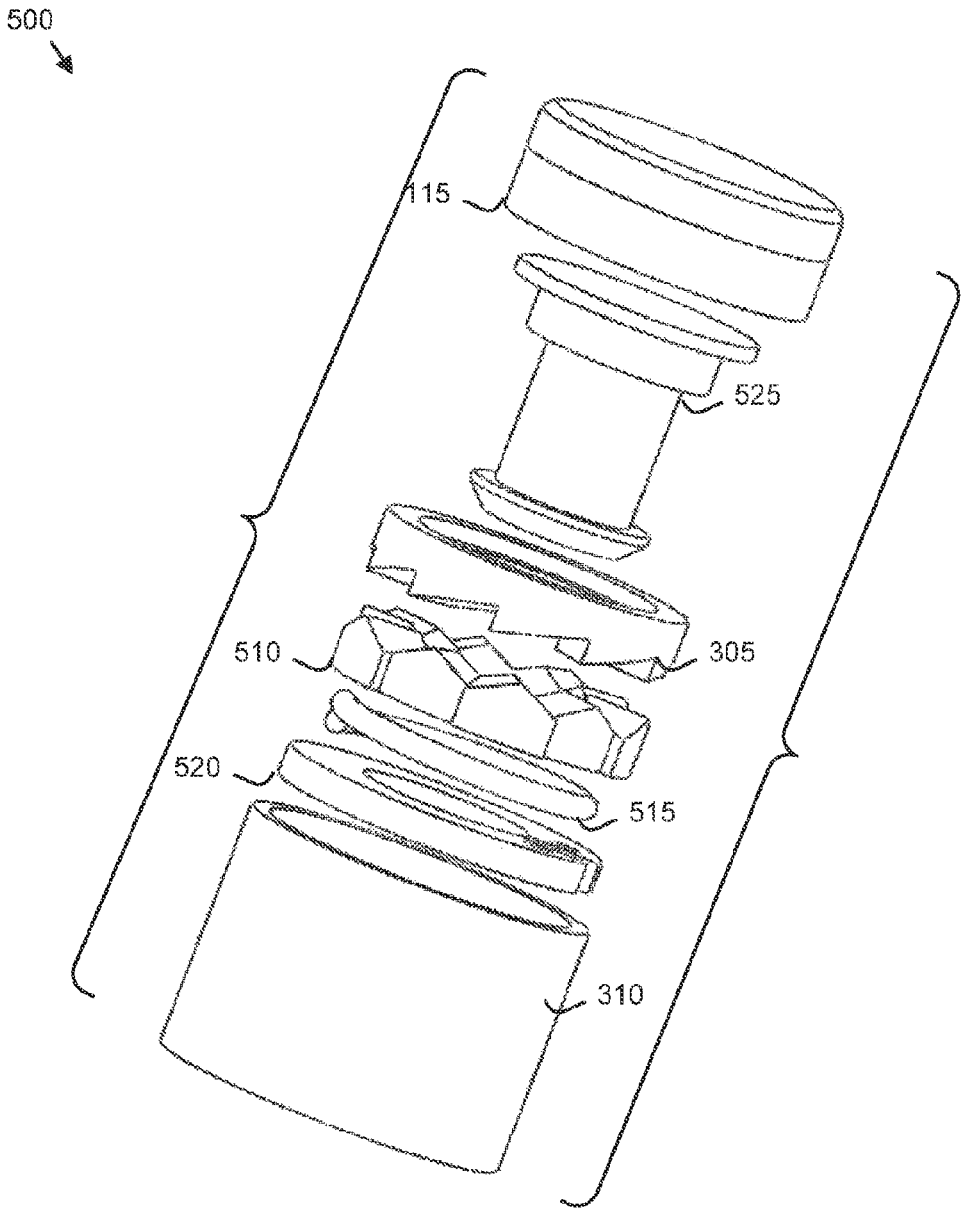
FIG. 7 is an exploded perspective view drawing illustrating one embodiment of an indexing cutter apparatus.

FIG. 7 is an exploded side-view drawing illustrating one embodiment of an indexing cutter apparatus 500. The apparatus 500 may be a species of the apparatus 200 of FIGS. 3-5. The description of the apparatus 500 refers to elements of FIGS. 1-6, like numbers referring to like elements. The apparatus 500 includes the cutter 115, the indexing cog 305, a stud 525, a push cog 510, a motivator spring 515, the locking ring 520, and the housing 310.

The cutter 115 is physically connected to the indexing cog 305. The cutter 115 may be physically connected to the indexing cog 305 via a bond, a fastener, a weld, and the like. The stud 525, push cog 510, motivator spring 515, and locking ring 520 may be embodied in the motivator 315. The stud 525 may be physically connected to the indexing cog 305. The stud 525 may be physically connected to the indexing cog 305 via a bond, a fastener, a weld, and the like. The locking ring 520 may secure the stud 525 to the housing 310 as will be shown hereafter.

Figure 8A:
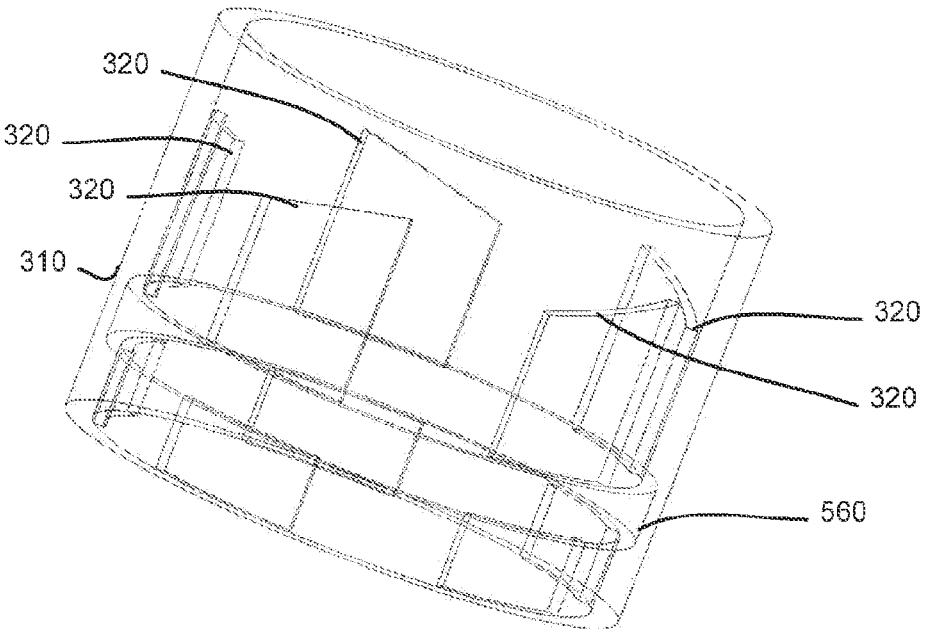
FIG. 8A is a perspective hidden-line drawing illustrating one embodiment of a housing.

FIG. 8A is a perspective hidden-line drawing illustrating one embodiment of a housing 310. The housing 310 is the housing 310 of FIG. 7. The description of the housing 310 refers to elements of FIGS. 1-7, like numbers referring to like elements. The housing 310 includes a plurality of protrusions 320 and a locking ring slot 560.

The protrusions 320 include a sloped top that interlocks with the indexing cog 305 as will be described hereafter. The locking ring slot 560 receives the locking ring 520 as will be described hereafter.

Figure 8B:
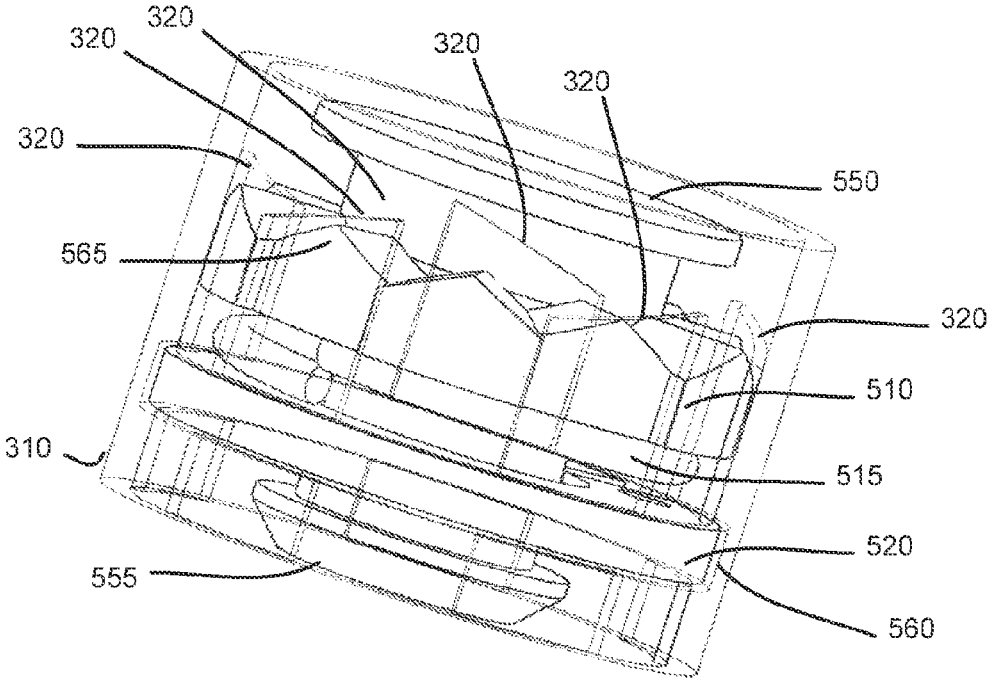
FIG. 8B is a perspective hidden-line drawing illustrating one embodiment of portions of the assembled indexing cutter apparatus.

FIG. 8B is a perspective drawing illustrating portions of the assembled indexing cutter apparatus 500. The apparatus 500 is the apparatus 500 of FIG. 7. The description of the apparatus 500 refers to elements of FIGS. 1-8A, like numbers referring to like elements.

The stud 525 includes a proximal end 550 and a distal end 555. The proximal end 550 may be physically connected to the indexing cog 305. The distal end 555 may be inserted through the push cog 510, the motivator spring 515, and the locking ring 520. In one embodiment, the locking ring 520 is compressed to a smaller diameter and fitted into the locking ring slot 560 of the housing 310. The locking ring 520 expands to fit within the locking ring slot 560, physically connecting the stud 525 to the housing 310 by securing the distal end 555 of the stud 525.

The motivator spring 515 may apply a force to the push cog 510. The force of the motivator spring 515 against the push cog 510 may attempt to disengage the indexing cog 305 from the housing 310. The push cog 510 may include a plurality of teeth. In one embodiment, at least one tooth 565 of the push cog 510 pushes against the indexing cog 305. For clarity, only a representative push cog tooth 565 is labeled.

Figure 9A:
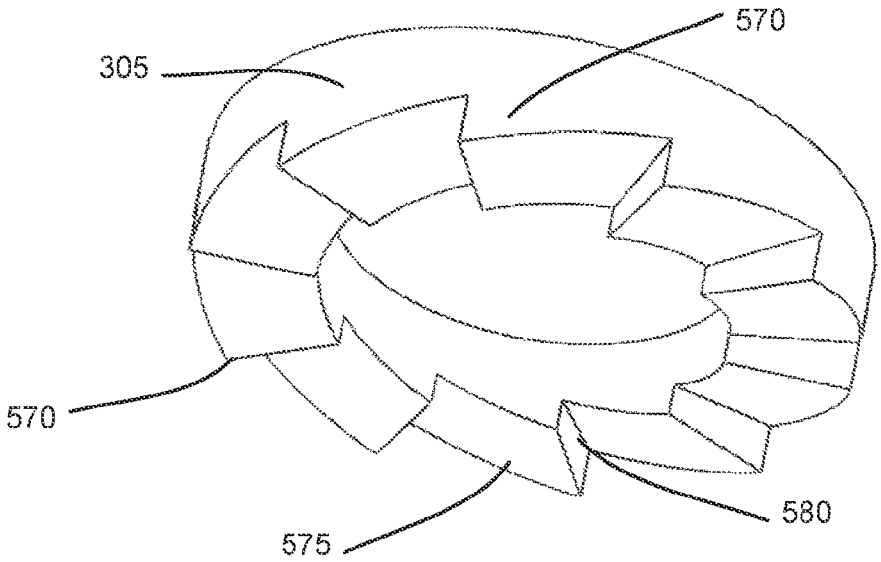
FIG. 9A is a perspective drawing illustrating one embodiment of an indexing cog.

FIG. 9A is a perspective drawing illustrating one embodiment of the indexing cog 305. The indexing cog 305 is the indexing cog 305 of FIG. 7. The description of the indexing cog 305 refers to elements of FIGS. 1-8, like numbers referring to like elements.

The indexing cog 305 may comprise a plurality of indexing cog teeth 570. For clarity, only representative indexing cog teeth 570 are labeled. At least one indexing cog tooth 570 may interlock with at least one protrusion 320 of the housing 310 in each of the plurality of index positions 325 as will be shown hereafter. In one embodiment, each indexing cog tooth 570 comprises a sloped face 575 and a vertical face 580.

When the compressive load is removed from the cutter 115, the force of the motivator spring 515 against the push cog 510 may push a push cog tooth 565 against a sloped face 575 of the indexing cog 305, disengaging the indexing cog 305 from the protrusions 320 of the housing 310. In addition, the force of the push cog tooth 565 against the sloped face 575 also generates a moment about the central axis 335, motivating the indexing cog 305 from the first index position 325*a* to the initial second index position 330*b*.

Figure 9B:
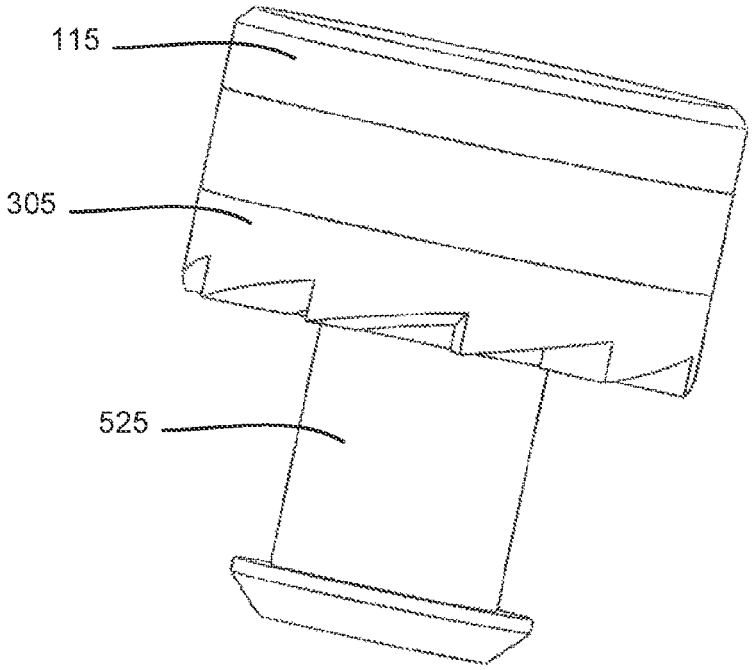
FIG. 9B is a perspective drawing illustrating one embodiment of portions of the assembled indexing cutter apparatus.

FIG. 9B is a perspective hidden-line drawing illustrating portions of the assembled indexing cutter apparatus 500. The apparatus 500 is the apparatus 500 of FIG. 7. The description of the apparatus 500 refers to elements of FIGS. 1-9A, like numbers referring to like elements. The proximal end 550 of the stud 525 is physically connected to the indexing cog 305. The physical connection may be a bond, a weld, a mechanical fastener, or the like. The indexing cog 305 is physically connected to the cutter 115. The physical connection may be a bond, a weld, a mechanical fastener, or the like.

Figure 10A:
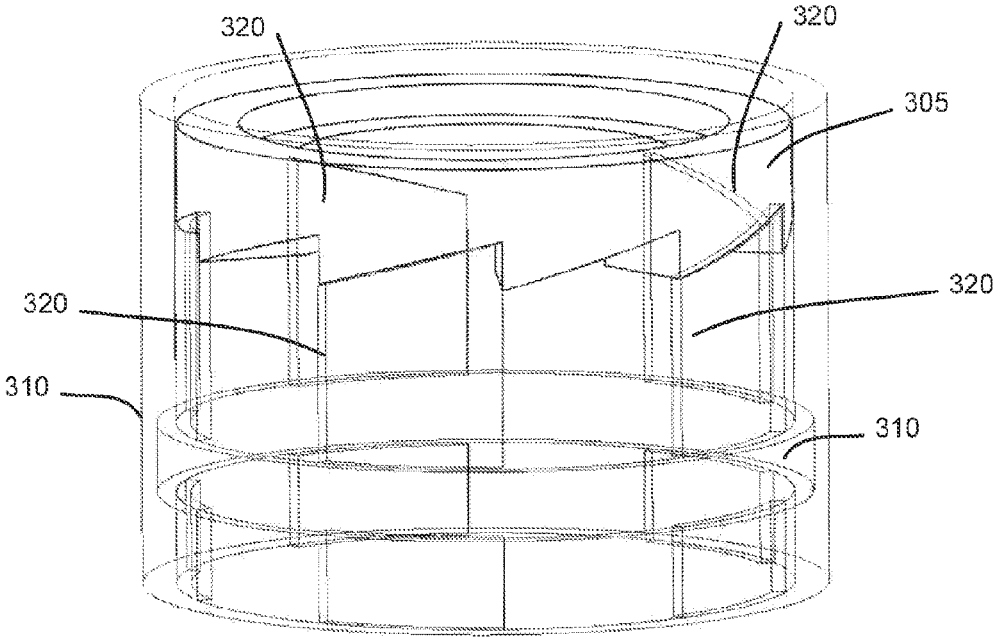
FIG. 10A is a perspective drawing illustrating one embodiment of an indexing cog interlocking with a housing.

FIG. 10A is a perspective drawing illustrating the indexing cog 305 interlocking with the housing 310. The indexing cog 305 and the housing 310 are the indexing cog 305 and housing 310 of FIG. 7. The description of the indexing cog 305 interlocking with the housing 310 refers to elements of FIGS. 1-9B, like numbers referring to like elements. For clarity, other components are not shown.

The housing 310 includes at least one protrusion 320. The protrusion 320 may be disposed along a cylinder wall of the housing. The space between the protrusions 320 may function as a channel to guide the push cog 510. In the depicted embodiment, each protrusion 320 has a sloped face that interlocks with the sloped face 575 of an indexing cog tooth 570. One of skill in art will recognize that embodiments may be practiced with other configurations of the protrusions 320 and the indexing cog 305 such that the indexing cog 305 interlocks with at least one protrusion 320.

Figure 10B:
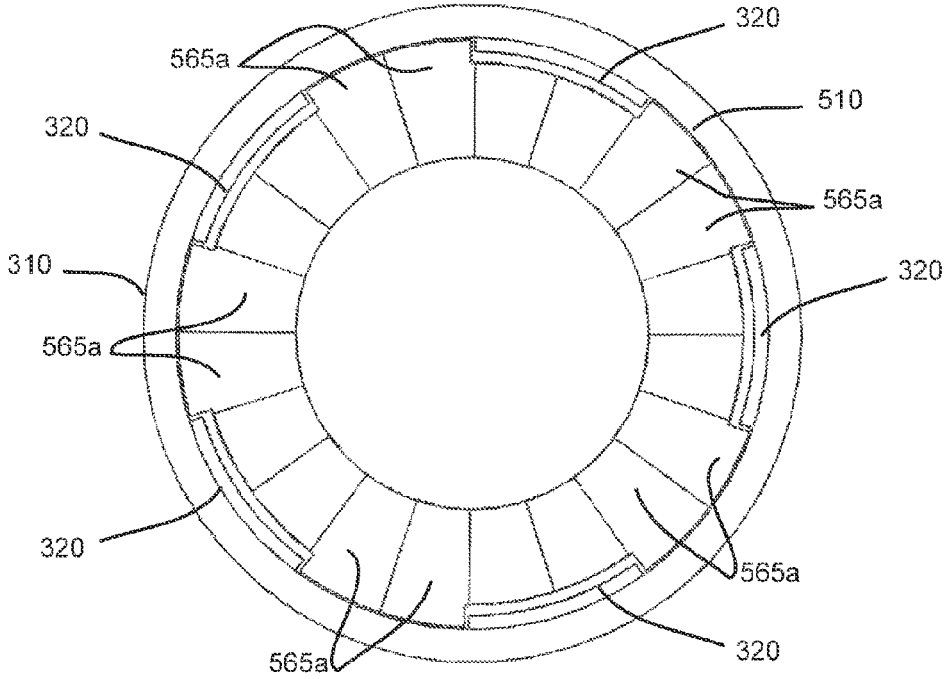
FIG. 10B is a top-view drawing illustrating one embodiment of a push cog interlocking with a housing.

FIG. 10B is a top-view drawing illustrating a push cog 510 interlocking with a housing 310. The push cog 510 and the housing 310 are the push cog 510 and housing 310 of FIG. 7. The description of the push cog 510 interlocking with the housing 310 refers to elements of FIGS. 1-10A, like numbers referring to like elements.

In the depicted embodiment, specified push cog teeth 565*a* of the push cog 510 fit in the space between the protrusions 320 of the housing, preventing the push cog 510 from rotating within the housing 310 and guiding the push cog 510 towards the indexing cog 305. Alternatively, other tongue and groove, guide and rail, or the like structures may be employed to prevent the push cog 510 from rotating in the housing 310 and to guide the push cog 510. In a certain embodiment, the housing 310 has a non-circular cross-section and the push cog 510 has a complementary non-circular cross-section.

Figure 11:
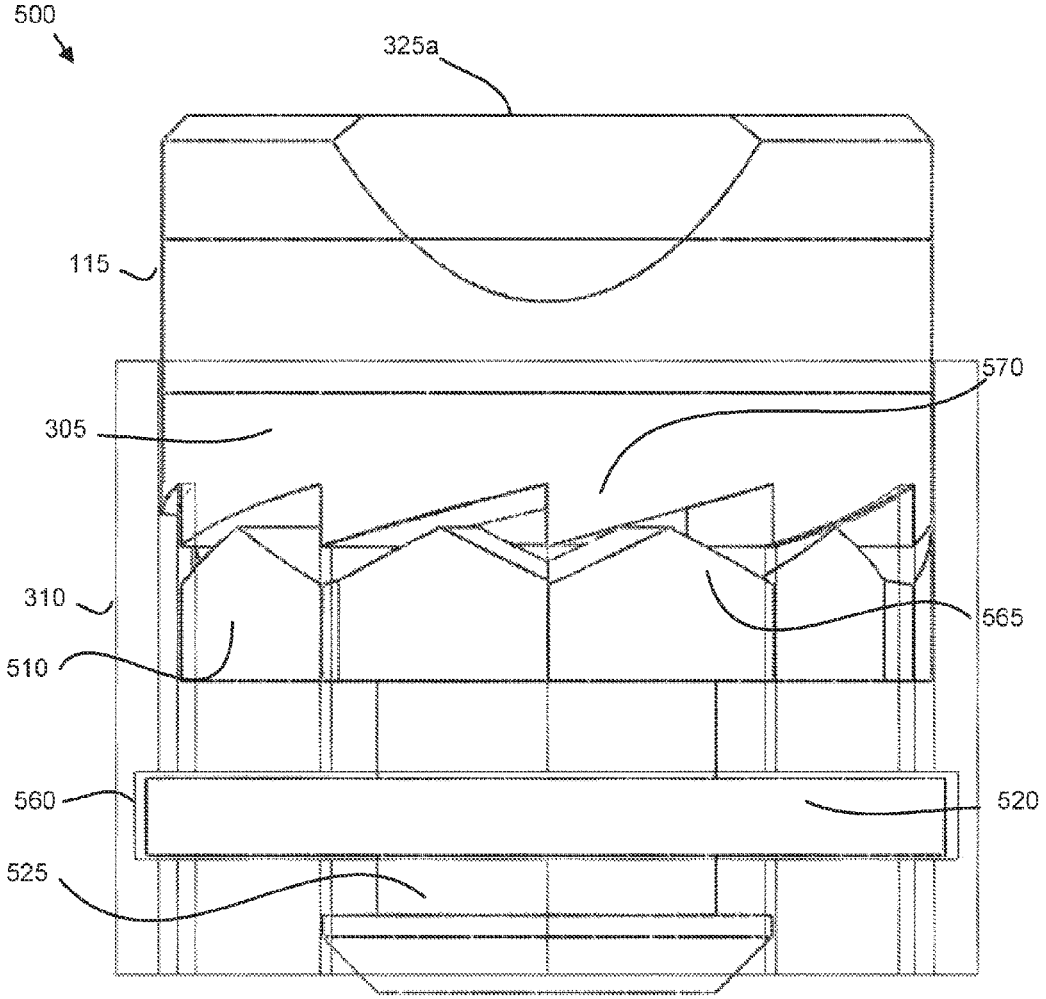
FIG. 11 is a side-view hidden-line drawing illustrating one embodiment of a compressed indexing cutter apparatus.

FIG. 11 is a side-view hidden-line drawing illustrating one embodiment of a compressed indexing cutter apparatus 500. The apparatus 500 may be the apparatus 500 of FIG. 7. The description of the apparatus 500 refers to elements of FIGS. 1-10, like numbers referring to like elements. The cutter 115 is shown in the first index position 325*a*. The compressive load prevents the motivator spring 515 (not shown for clarity) and the push cog 510 from disengaging the indexing cog 305 from the housing 310.

Figure 12:
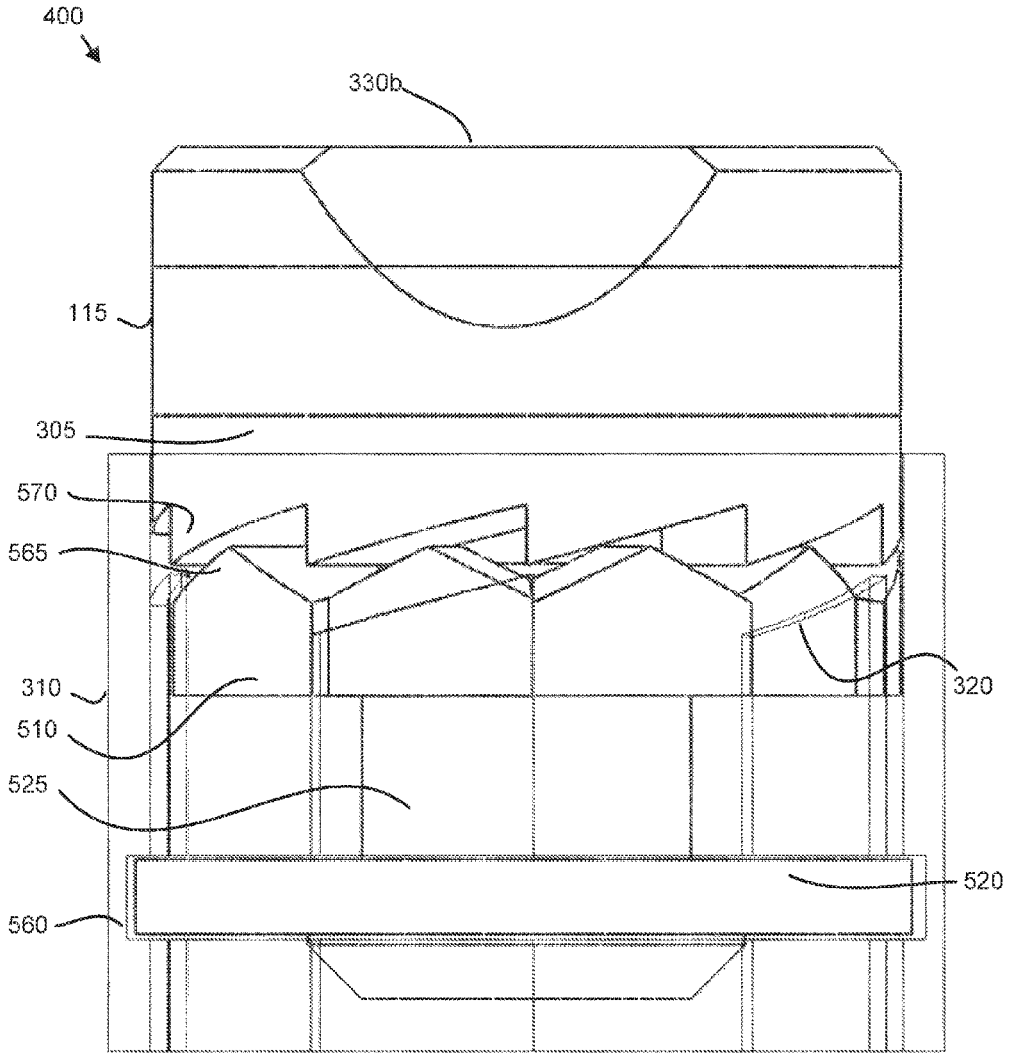
FIG. 12 is a side-view hidden-line drawing illustrating one embodiment of an uncompressed indexing cutter apparatus.

FIG. 12 is a side-view hidden-line drawing illustrating one embodiment of an uncompressed indexing cutter apparatus 500. The apparatus 500 may be the apparatus 500 of FIG. 11 with the compressive load removed. The description of the apparatus 500 refers to elements of FIGS. 1-11, like numbers referring to like elements. With the compressive load removed, the motivator spring 515 (not shown for clarity) has pushed the push cog 510 against the indexing cog 305. Because there is no compressive load to counteract the motivator spring 515, the indexing cog 305 is disengaged from the protrusions 320 of the housing 310.

The cutter 115 is shown moved to the initial second index position 330*b*. In one embodiment, the initial second index position 330*b* is disposed so that the reapplication of the compressive load on the cutter 115 will push the sloped face 575 of at least one indexing cog tooth 570 to contact a protrusion 320 and guide the indexing cog 305 to interlock with a protrusion 320 in the second index position 325*b*.

Figure 13:
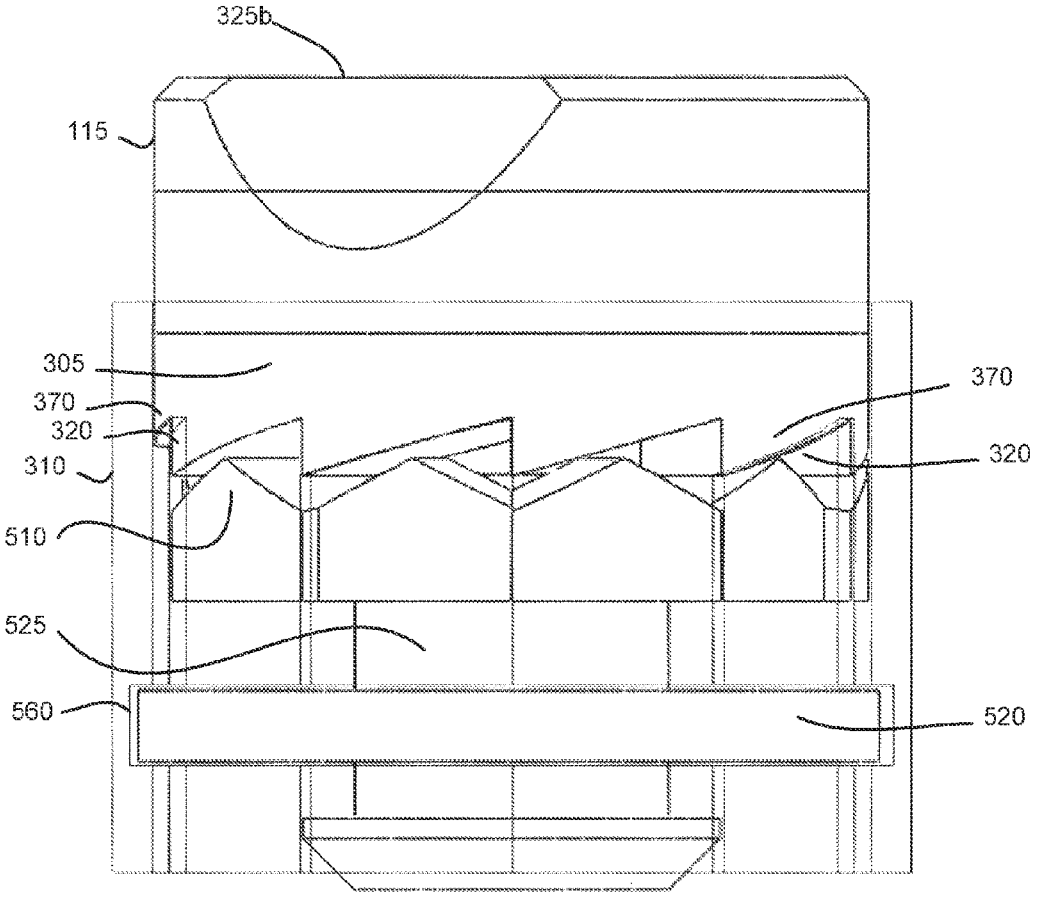
FIG. 13 is a side-view hidden-line drawing illustrating one embodiment of a recompressed indexing cutter apparatus.

FIG. 13 is a side-view hidden-line drawing illustrating one embodiment of a recompressed indexing cutter apparatus 500. The apparatus 500 may be the apparatus 500 of FIG. 12 with the compressive load reapplied as a second compressive load. The description of the apparatus 500 refers to elements of FIGS. 1-12, like numbers referring to like elements. With the reapplication of the compressive load, the sloped face 575 may slide along the protrusion 320 as the cutter 115 is pushed toward the housing 310 by the compressive load, generating a moment that rotates the indexing cog 305 and the cutter 115 about the central axis 335 into the second index position 330. The protrusion 320 and at least one indexing cog tooth 570 may prevent further rotation of the indexing cog 305 and the cutter 115 about the central axis 335 when the indexing cog 305 is interlocked in the second index position 325*b* while the compressive load is applied to the cutter 115.

Figure 14:
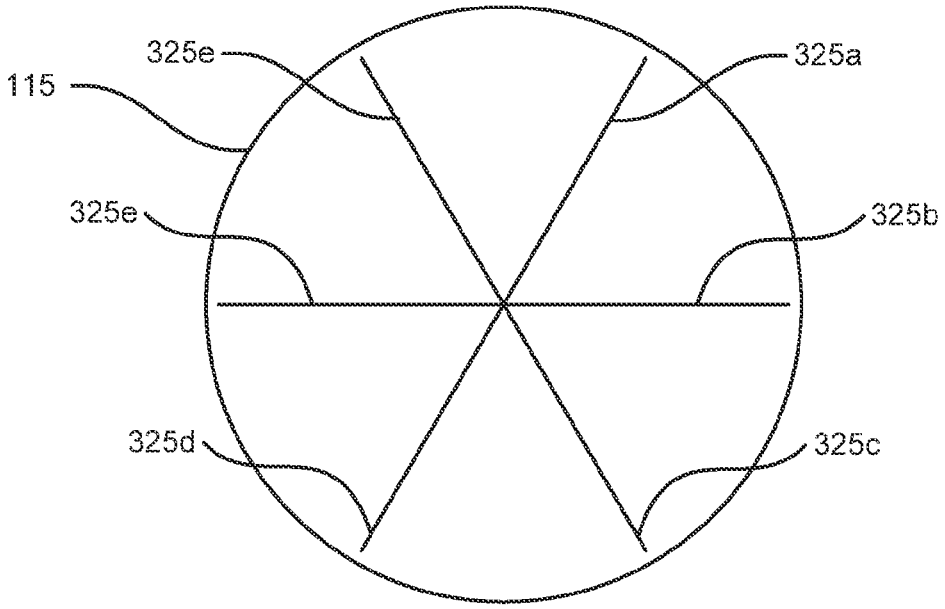
FIG. 14 is a top-view drawing illustrating index positions of the cutter.

FIG. 14 is a top-view drawing illustrating index positions 325 of the cutter 115. The description of the index positions 325 refers to elements of FIGS. 1-14, like numbers referring to like elements. The depicted embodiment shows six index positions for the cutter 115. In one embodiment, the cutter 115 may be positioned in one index position 325 of plurality of index positions 325, the number of the plurality of index positions 325 in the range of 2 to 32 index positions 325. Alternatively, the number of plurality of index positions 325 may be in the range of 4 to 8 index positions 325. In a certain embodiment, the number of the plurality index positions 325 is in the range of 6 to 8 index positions 325. Alternatively, the number of the plurality of index positions 325 is in the range of 4 to 6 index positions 325.

Figure 15:
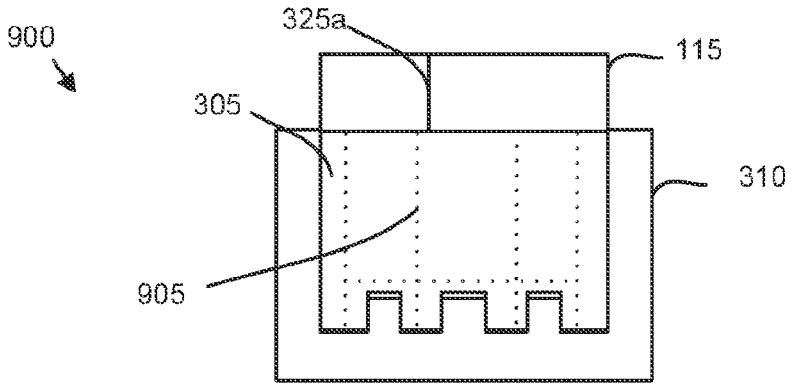
FIG. 15 is a side-view hidden-line drawing illustrating one alternate embodiment of a compressed indexing cutter apparatus.

FIG. 15 is a side-view drawing illustrating one alternate embodiment of a compressed indexing cutter apparatus 900. The apparatus 900 may be an alternate species of the apparatus 200 of FIGS. 3-5. The description of the apparatus 900 refers to elements of FIGS. 1-14, like numbers referring to like elements.

The indexing cog 305 is shown interlocked with protrusions 320 of the housing 310 in response to the compressive load. The indexing cog 305 is positioned in the first indexing position 325*a*. A first spring 905 applies a force to separate the indexing cog 305 and the housing 310, but in the depicted embodiment, the force of the first spring 905 is insufficient to disengage the indexing cog 305 from the housing 310.

Figure 16:
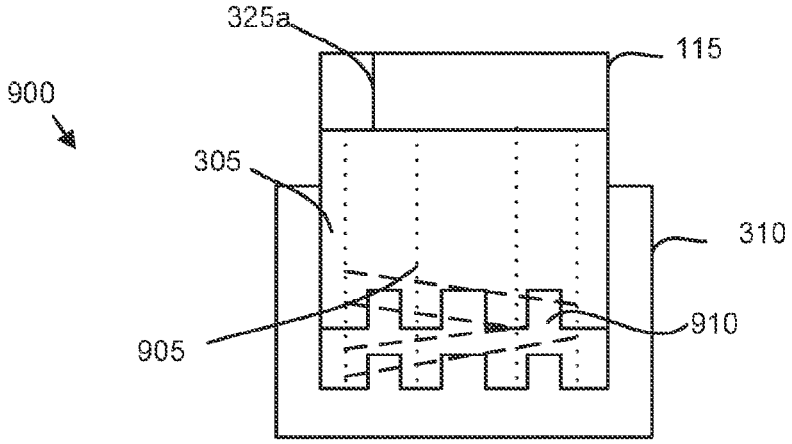
FIG. 16 is a side-view hidden-line drawing illustrating one alternate embodiment of an uncompressed indexing cutter apparatus.

FIG. 16 is a side-view drawing illustrating one alternate embodiment of an uncompressed indexing cutter apparatus 900. The apparatus 900 is the apparatus 900 of FIG. 15 when the compressive load is removed from the cutter 115. The description of the apparatus 900 refers to elements of FIGS. 1-15, like numbers referring to like elements.

In one embodiment, the first spring 905 applies a force that disengages the indexing cog 305 from the housing 310. In a certain embodiment, a second spring 910 applies a moment about the central axis 335 to rotate the indexing cog 305 to the initial second index position 330*b* as will be described hereafter in the description of FIG. 17.

Figure 17:
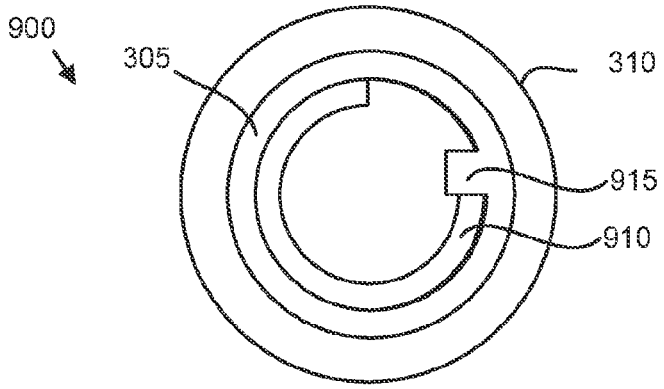
FIG. 17 is a top-view drawing illustrating one alternate embodiment of a motivator spring.

FIG. 17 is a top-view drawing illustrating one alternate embodiment of the second spring 910 of FIG. 16 within the housing 310. The description of the apparatus 900 refers to elements of FIGS. 1-16, like numbers referring to like elements. The second spring 910 may apply a force to a knob 915 of the indexing cog 305, generating a moment about the central axis 335.

Figure 18:
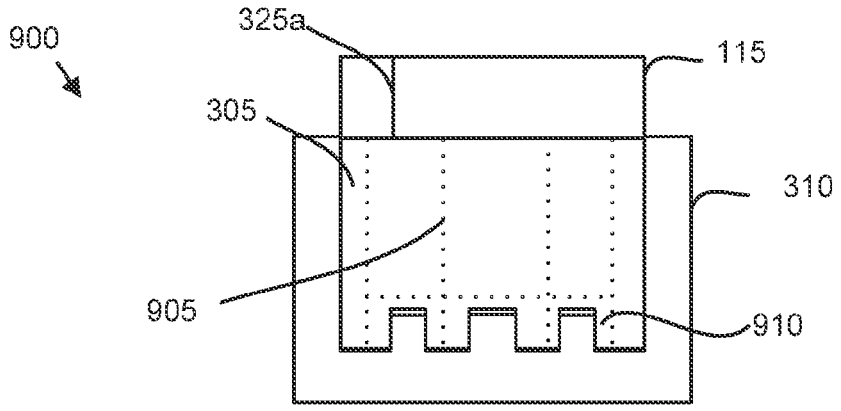
FIG. 18 is a side-view hidden-line drawing illustrating one alternate embodiment of a recompressed indexing cutter apparatus.

FIG. 18 is a side-view drawing illustrating one alternate embodiment of a recompressed indexing cutter apparatus 900. The apparatus 900 is the apparatus 900 of FIG. 16 when the compressive load is reapplied as a second compressive load to the cutter 115. The description of the apparatus 900 refers to elements of FIGS. 1-17, like numbers referring to like elements. The second compressive force pushes the indexing cog 305 to interlock with the housing 310 in the second index position 325*b*.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of drilling a subterranean formation, the method comprising:

providing a drill bit, the drill bit including a body and at least one cutter coupled with the body;

engaging a subterranean formation with the drill bit including sequentially applying a first force to the at least one cutter, removing the first force from the at least one cutter, and applying a second force to the at least one cutter;

rotating the at least one cutter from the first indexed position to a second indexed position responsive to the removal of the first force and the application of the second force;

coupling the at least one cutter with the body by way of a housing member disposed at least partially between the at least one cutter and the body;

wherein rotating the at least one cutter includes engaging an indexing cog with a portion of the housing.

2. The method according to claim 1, wherein the at least one cutter is displaced relative to the body in a direction parallel to a rotational axis of the at least one cutter responsive to at least one of the application of the first force, removal of the first force and application of the second force.

3. The method according to claim 1, further comprising maintaining the at least one cutter at the second indexed position until the second force is removed from the at least one cutter.

4. The method according to claim 3, further comprising applying a third force to the at least one cutter and rotating the cutter from the second indexed position to a third indexed position responsive to the removal of the second force and the application of the third force.

5. The method according to claim 1, wherein applying a first force includes engaging the subterranean formation with the at least one cutter by rotating the drill bit within a bore hole.

6. The method according to claim 1, further comprising maintaining the coupling of the at least one cutter with the body during the rotation of the cutter.

7. The method according to claim 1, further comprising rotating the at least one cutter through a plurality of indexing positions, wherein total of all indexing positions of the at least one cutter include between 2 and 32 indexing positions.

8. The method according to claim 1, wherein the total of all indexing positions of the at least one cutter include between 4 and 8 indexing positions.

9. The method according to claim 1, further comprising maintaining a biasing force between the body and the at least one cutter.

10. The method according to claim 1, further comprising maintaining the at least one cutter at a first indexed position relative to the body while the first force is applied to the at least one cutter.

11. A method of drilling a subterranean formation, the method comprising:

providing a drill bit, the drill bit including a body and at least one cutter coupled with the body;

engaging a subterranean formation with the drill bit including sequentially applying a first force to the at least one cutter, removing the first force from the at least one cutter, and applying a second force to the at least one cutter;

rotating the at least one cutter from the first indexed position to a second indexed position responsive to the removal of the first force and the application of the second force, wherein rotating the at least one cutter includes engaging an indexing cog with a push cog.

12. A drill bit comprising:

a bit body;

at least one cutter coupled with the body;

a mechanism associated with the at least one cutter including an indexing cog coupled with the at least one cutter, the mechanism being configured to position the at least one cutter in a first indexed position relative to the bit body while a first force is applied to the at least one cutter, and enable the at least one cutter to rotate to a second indexed position relative to the bit body responsive to the release of the first force and application of a second force to the at least one cutter.

13. The drill bit of claim 12, wherein the at least one cutter includes a polycrystalline diamond table.

14. The drill bit of claim 12, wherein the mechanism includes at least one biasing member configured to apply a biasing force to the at least one cutter.

15. The drill bit of claim 14, wherein the at least one biasing member is configured to apply the biasing force in a direction parallel to an axis of rotation of the at least one cutter.

16. The drill bit of claim 14, wherein the at least one biasing member is configured to apply a biasing force is configured to apply a rotational force about a rotational axis of the at least one cutter.

17. The drill bit of claim 12, wherein the mechanism includes a housing disposed between the at least one cutter and the bit body, the housing including features configured to engage the indexing cog.

18. The drill bit of claim 12, wherein the mechanism further includes a push cog configured to engage the indexing cog.

* * * * *